US008919983B2

(12) United States Patent
Murray

(10) Patent No.: US 8,919,983 B2
(45) Date of Patent: Dec. 30, 2014

(54) BACKLIT ELECTRONIC JEWELRY AND FASHION ACCESSORIES

(71) Applicant: Elizabethanne Murray, Warrenton, VA (US)

(72) Inventor: Elizabethanne Murray, Warrenton, VA (US)

(73) Assignee: Elizabethanne Murray, Warrenton, VA (US)

( * ) Notice: Subject to any disclaimer, the term of this patent is extended or adjusted under 35 U.S.C. 154(b) by 0 days.

(21) Appl. No.: 13/911,701

(22) Filed: Jun. 6, 2013

(65) Prior Publication Data

US 2013/0329402 A1 Dec. 12, 2013

Related U.S. Application Data

(60) Provisional application No. 61/656,203, filed on Jun. 6, 2012.

(51) Int. Cl.
*F21V 21/08* (2006.01)
*A44C 15/00* (2006.01)

(52) U.S. Cl.
CPC ..... *A44C 15/0015* (2013.01)
USPC ..... 362/104; 362/311.02; 362/355

(58) Field of Classification Search
USPC ..... 362/103–104, 249.02
See application file for complete search history.

(56) References Cited

U.S. PATENT DOCUMENTS

| | | | | |
|---|---|---|---|---|
| 4,271,457 | A | 6/1981 | Martin | |
| 4,309,743 | A | 1/1982 | Martin | |
| 5,690,412 | A * | 11/1997 | Sheldon | 362/104 |
| 5,876,109 | A | 3/1999 | Scalco | |
| 6,433,483 | B1 * | 8/2002 | Michael et al. | 315/76 |
| 6,833,539 | B1 * | 12/2004 | Maeda | 250/214 AL |
| 7,040,778 | B2 * | 5/2006 | Villarreal et al. | 362/204 |
| 7,441,917 | B1 | 10/2008 | Underdown et al. | |
| 7,708,421 | B2 | 5/2010 | Underdown et al. | |
| 7,775,681 | B2 * | 8/2010 | Kim et al. | 362/249.02 |
| 8,482,909 | B2 * | 7/2013 | Douglas | 361/679.03 |
| 2003/0026090 | A1 * | 2/2003 | Bornovski | 362/104 |
| 2009/0051624 | A1 * | 2/2009 | Finney et al. | 345/30 |
| 2011/0194276 | A1 * | 8/2011 | Au | 362/104 |
| 2011/0205859 | A1 * | 8/2011 | Durpetti | 368/285 |

* cited by examiner

*Primary Examiner* — Donald Raleigh
(74) *Attorney, Agent, or Firm* — Wegman, Hessler & Vanderburg

(57) ABSTRACT

A wearable piece of jewelry is provided including a light transmissive pane and a lighting device. The light transmissive pane is located between a viewer and said lighting device. Further examples of the jewelry can include a frame to locate the light transmissive pane and a diffusion panel. The jewelry can also include a controller in electrical communication with the lighting device and a communication device in electrical connection/communication with the controller. Another example of the jewelry includes a solar cell in electrical connection/communication with the lighting device.

19 Claims, 4 Drawing Sheets

BACKLIT ELECTRONIC JEWELRY AND FASHION ACCESSORIES

This application claims the benefit of U.S. Provisional Application No. 61/656,203, filed Jun. 6, 2012, the entire disclosure of which is hereby incorporated herein by reference.

BACKGROUND

1. Technical Field

The present disclosure relates to wearable jewelry and more particularly to wearable jewelry including lighting with electronic or electrical circuitry.

2. Discussion of Prior Art

Use of jewelry including lighting devices, is known. Such devices can be used, for example, to light pins used for advertising with solid or flashing lights. However, these devices are not known for including interchangeable objects that can be backlit and adaptable to suit a wearer's mood or whim. Furthermore, many of the known jewelry devices use plastic molded solely for the purpose of use in advertising or novelty pins. Meanwhile, many discarded items that can be used as jewelry are simply thrown away. Thus, there is a need for both improvements to wearable lighted jewelry and developments to increase the use of discarded materials.

BRIEF DESCRIPTION

The following summary presents a simplified summary in order to provide a basic understanding of some aspects of the systems and/or methods discussed herein. This summary is not an extensive overview of the systems and/or methods discussed herein. It is not intended to identify key/critical elements or to delineate the scope of such systems and/or methods. Its sole purpose is to present some concepts in a simplified form as a prelude to the more detailed description that is presented later.

One aspect of the disclosure provides a wearable piece of jewelry including a light transmissive pane. The wearable piece of jewelry also includes a lighting device. The lighting device is configured to be selectively activated to pass light through the light transmissive pane. The light transmissive pane is located between a viewer and the lighting device.

Another aspect of the disclosure provides a wearable piece of jewelry including a light transmissive pane. The wearable piece of jewelry also includes a lighting device configured to be selectively activated to pass light through the light transmissive pane. The wearable piece of jewelry further includes a diffusion panel located between the light transmissive pane and the lighting device. The diffusion panel removes hot spots and diffuses light from the lighting device relatively evenly over one surface of the light transmissive pane. The wearable piece of jewelry still further includes a frame bounding at least one portion of the light transmissive pane to hold the light transmissive pane in a desired location. The frame locates the light transmissive pane between a viewer and said lighting device.

Another aspect of the disclosure provides a wearable piece of jewelry including a lighting device. The wearable piece of jewelry also includes a controller in electrical communication with the lighting device and a communication device in electrical communication with the controller.

BRIEF DESCRIPTION OF THE DRAWINGS

The foregoing and other aspects of the present disclosure will become apparent to those skilled in the art to which the present disclosure relates upon reading the following description with reference to the accompanying drawings, in which.

DETAILED DESCRIPTION

Figure 1:
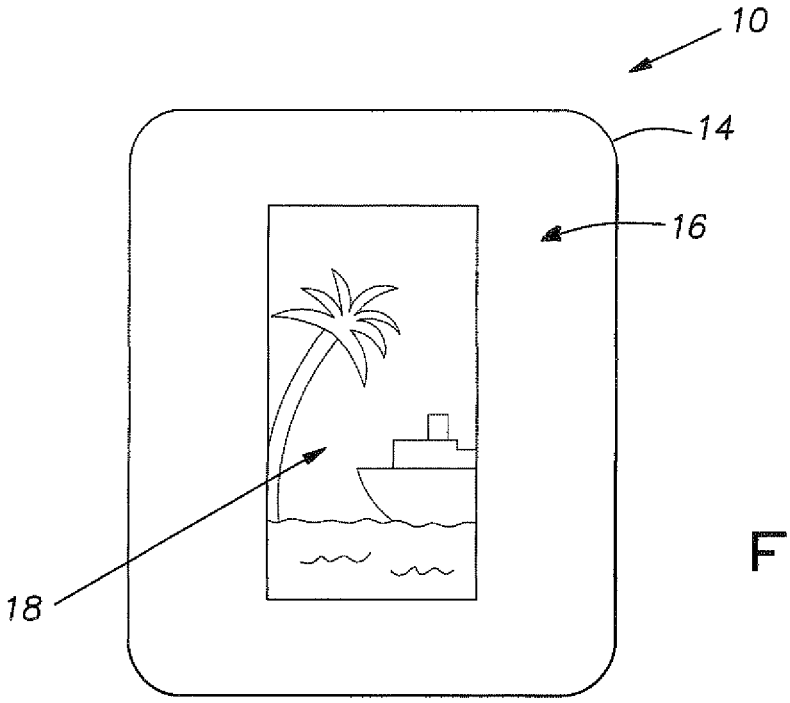
FIG. 1 is schematic front view of an example wearable piece of jewelry according to at least one aspect of the present disclosure.

Example embodiments that incorporate one or more aspects of this disclosure are described and illustrated in the drawings. These illustrated examples are not intended to be a limitation on the disclosure. For example, one or more aspects of the disclosure can be utilized in other embodiments and even other types of devices. Moreover, certain terminology is used herein for convenience only and is not to be taken as a limitation on the disclosure. Still further, in the drawings, the same reference numerals are employed for designating the same elements.

An example of a wearable piece of jewelry 10 in accordance with aspects of the present disclosure is schematically shown in FIG. 1. It is to be appreciated that the example is for illustrative purposes only and need not present specific limitations upon the scope of the present disclosure. The wearable piece of jewelry 10 uses a form of illumination to aid in the display of a desired artwork, natural phenomenon, photography, etc.

The wearable piece of jewelry 10 includes a light transmissive pane 14. The light transmissive pane 14 can be any number of objects including, but not limited to, a photographic slide, such as shown in FIG. 1, sea glass, stained glass, etched glass, shell, bone, rock, minerals, precious gemstones, portions of glass such as bottles, film negatives, processed film, thin paper, animation cels, plastic, etched plastic, encased liquids, encased combinations of liquids and solids, mounted scientific slides, or combinations of these objects. While the present disclosure focuses on a 35 mm photographic slide as one example of a light transmissive pane 14, it is not a limiting example, and it is to be appreciated that any number of light transmissive objects are readily used in the wearable piece of jewelry 10 of the present disclosure.

FIG. 1 illustrates the front view of the wearable piece of jewelry 10 as a representation of how others who are not wearing the wearable piece of jewelry 10 would view the wearable piece of jewelry 10, or how it may be seen by the wearer when viewing it in a mirror. The photographic slide as shown can include an opaque frame 16 found on typical 35 mm photographic slides. The photographic slide can also include a processed film segment, at least a portion of which is translucent or transparent. The photographic slide has a front side 18.

Figure 2:
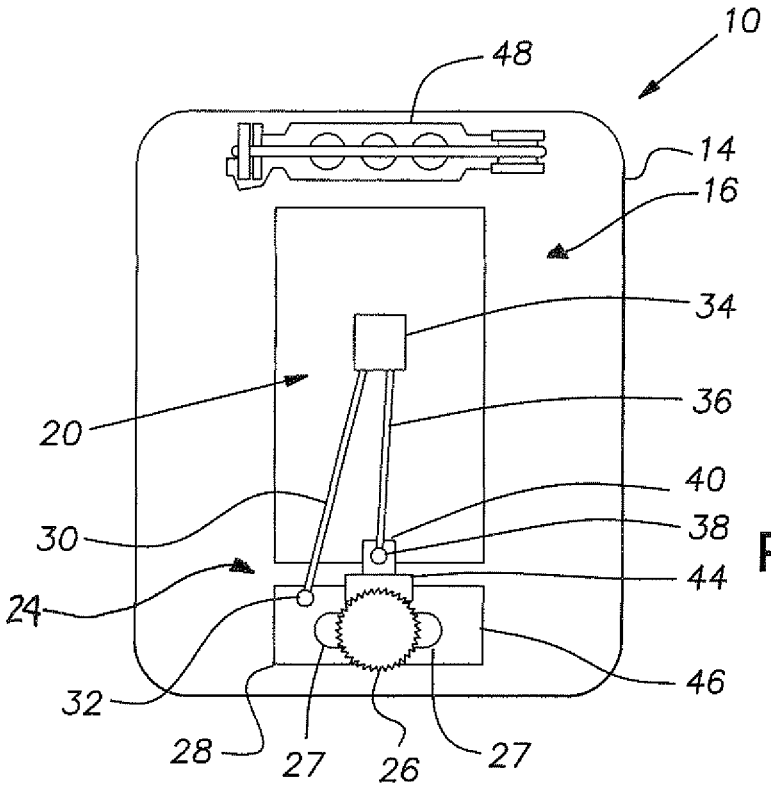
FIG. 2 is a schematic rear view of the wearable piece of jewelry of FIG. 1 showing an electrical circuit and a lighting device.

Turning to FIG. 2, a view of the rear of the wearable piece of jewelry 10 is illustrated and is the opposite side from that shown in FIG. 1. The processed film segment of the photographic slide can have a rear side 20. The light transmissive pane 14 is located between a viewer and a lighting device 34. Any suitable lighting device 34 can be used, including, but not limited to light emitting diodes (LED), liquid crystal displays (LCD), incandescent lights, electroluminescent material, organic LED (OLED), cold-cathode fluorescent lights, or any combination of these examples.

In one example, a lighting device 34 such as an LED can be used to cast light onto the rear side 20 of the light transmissive pane 14, for example, the rear of the photographic slide. Light from the lighting device 34 passes through at least a portion of the photographic slide and then on to be perceived by a viewer. In one example, a viewer can be a human looking at the wearable piece of jewelry 10. In another example, a viewer may be a camera or other recording device. In yet another example, the lighting device 34 can emit electromagnetic radiation such as infrared or near-infrared wavelengths. For example, the lighting device 34 can be configured to emit near-infrared wavelength electromagnetic radiation as the sole illumination wavelength, or as an additional illumination wavelength. As such, the light transmissive pane 14 can present a different image to human vision versus that of a camera or other sensor or detector. In additional examples, the lighting device 34 may emit electromagnetic radiation that is not visible at all to the human eye but may be detected by a detector such as a camera or other similar device. The various lighting device 34 electromagnetic radiation emissions can have any number of useful purposes, including automated identification of a wearer of the wearable piece of jewelry 10, etc. In still yet another example, a plurality of wearable pieces of jewelry 10 can each include a lighting device 34 configured to emit a specific wavelength or combination of wavelengths to provide specific, positive identification of the wearer.

LED lighting devices are shown in several of the figures, but this is not meant to be limiting. In one example, the LED lighting device can be a single LED. In other examples, the LED can emit predominantly white light. Further examples can include multiple LEDs in one lighting device which emit predominantly white light, or another portion of the visible spectrum, such as blue light. In other examples, the LEDs of a lighting device can include LEDs emitting several different portions of the visible spectrum (i.e., several different colors). In another example, the lighting device can be an LED package that is designed with lenses to focus the LED light output to a broad area despite being a short distance from the backlit surface of the light transmissive pane. Such LED packages are commercially available. It is to be appreciated that LEDs offer certain benefits over some other lighting device choices in that LEDs can be manufactured at low cost, take up little space in a piece of jewelry, have low electrical operating requirements, and are functional for a relatively long period of time.

As seen in FIG. 2, the wearable piece of jewelry 10 can include circuitry to operate the lighting device 34. In one example, copper foil tape 28 (or "copper tape") is applied to the light transmissive pane 14 and is used as a conducting element in an electrical circuit 24. In one example, the copper foil tape 28 can be applied directly to the light transmissive pane 14. In the shown example, the copper foil tape 28 is applied to the opaque frame 16 of the photographic slide. The copper foil tape 28 both adheres to the light transmissive pane 14 or the opaque frame 16 while providing an electrically conductive pathway for the electrical circuit 24. Furthermore, the copper foil tape 28 provides a material surface to support soldering operations to add components to the electrical circuit 24.

In one example, a strip of copper foil tape 28 is applied to the opaque frame 16. A battery device 26 is soldered to the copper foil tape 28 in at least one location, generally designated by reference numeral 27. This soldering operation holds the battery device 26 on the wearable piece of jewelry 10 and provides an electrical connection with the electrical circuit 24. In one example, the battery device 26 can be a button cell battery canister holding a lithium battery. In the shown example, the solder connection between the button cell battery canister can be limited to particular points of the canister to maintain a desired path of the electrical circuit 24. The canister can include a threaded cap configured to move the button cell battery into connection with a part of the electrical circuit 24 as the threaded cap is tightened onto the button cell battery canister. This electrical connection with the button cell battery will be described below in greater detail relating to the remainder of the electrical circuit 24. It is to be appreciated that this is only one example of a battery device 26, and any suitable battery device 26 can be used with the present disclosure. Furthermore, the button cell battery canister can act as a switch for the electrical circuit 24. The threaded cap is configured to move the button cell battery into connection with a part of the electrical circuit 24 as the threaded cap is tightened onto the button cell battery canister as described above, and similarly, loosening the threaded cap can remove the button cell battery from connection with a part of the electrical circuit 24.

Another electrical conductor 30 is placed in electrical communication with the battery device 26 by a solder connection 32 on the copper foil tape 28. The electrical conductor 30 is in electrical communication with the lighting device 34 as shown in FIG. 2. In one example, the electrical conductor 30 can be a typical electrical lead which is integrated to the LED lighting device at the time of its manufacture. Use of the lead in this way helps to lower the cost, assembly time and effort of the wearable piece of jewelry 10. Similarly, a second lead from the LED lighting device can be used as an electrical conductor 36. Electrical conductor 36 can be placed in electrical communication with a second piece of copper foil tape 40 by a solder connection 38.

Copper foil tape 40 is in electrical communication with the opposite side of the battery device 26 than the connection between the battery device 26 and the copper foil tape 28. As shown in FIG. 2, the copper foil tape 40 is at least partially placed under the button cell battery canister. As the threaded cap is tightened onto the button cell battery canister, the button cell is urged toward the copper foil tape 40 and is placed into contact with the copper foil tape to complete the electrical circuit 24. In the shown example, it is desirable to separate the copper foil tape 40 from particular sections of the button cell battery canister. For example, a connection between the copper foil tape 40 and the sides of the button battery canister can "short" the electrical circuit 24, and render the electrical circuit 24 ineffective. As such, an insulating material 44 is placed between the bottom of the button battery canister and the copper foil tape 40 at the circumference of the button battery canister. However, the insulating material 44 is not present between the button battery within the battery device 26 and the copper foil tape 40 so that the battery device 26 and the copper foil tape 40 can be selectively placed into electrical communication with one another.

Similarly, it is desirable to prevent electrical communication between the two copper foil tapes 28, 40. As such, the copper foil tape 28 can have a central circular portion removed such that the copper foil tape 40 (and the battery) do not come into contact with the copper foil tape 28. Alternatively, the copper foil tape 28 can be provided in two sections such as copper foil tape 28 on the left side of FIG. 2 and a copper foil tape right side 46 being completely separate from one another.

An attachment device can be located on the wearable piece of jewelry 10. For example, a typical pin-back attachment 48 can be attached to the light transmissive pane 14 so that the wearable piece of jewelry 10 can be worn as a pin, a brooch, or otherwise decorate objects that can interface with pin-back attachments 48. In other examples, the wearable piece of jewelry 10 can include attachment devices configured to interface with bracelets, anklets, necklaces, rings, etc.

Figure 3:
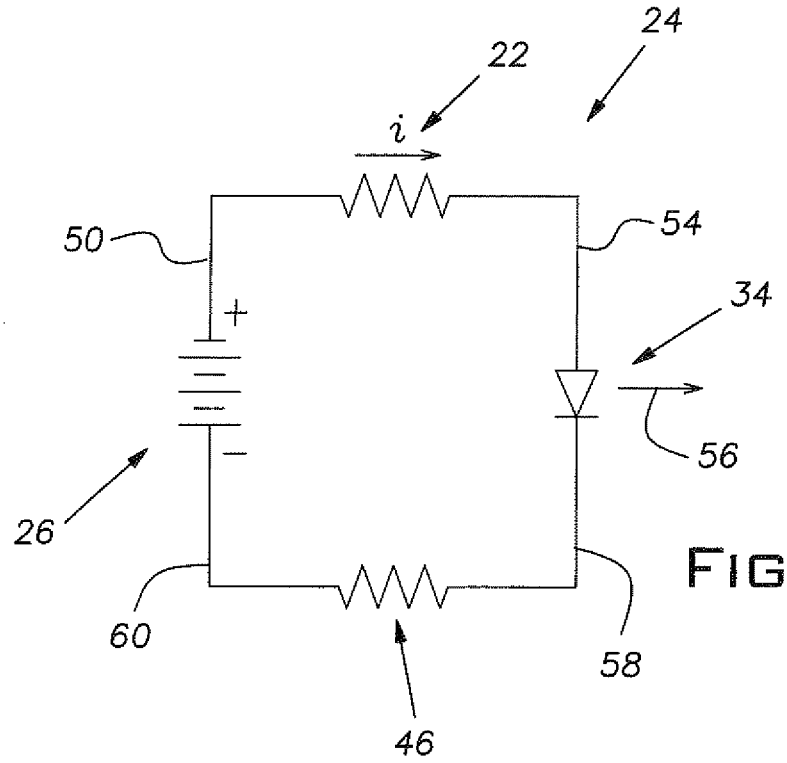
FIG. 3 is an electrical schematic representing the electrical circuit of the wearable piece of jewelry of FIG. 2.
Figure 4:
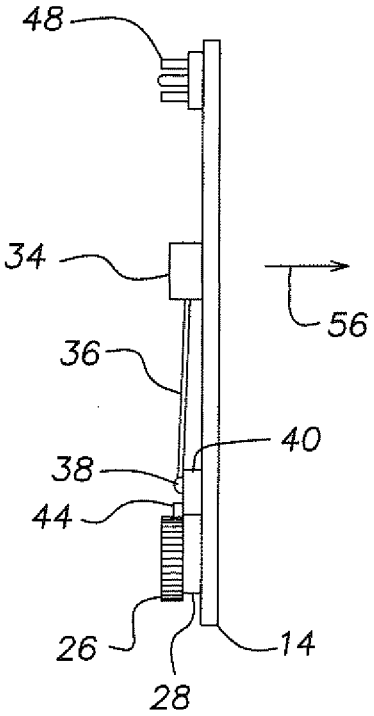
FIG. 4 is a schematic side view of the wearable piece of jewelry of FIG. 1.

Turning to FIG. 3, a simple electrical schematic is illustrated. An electrical signal for electrical circuit 24 can be created by the battery device 26 and move along the conductor 50 to a resistor in a clockwise direction. As shown in FIG. 2, the copper foil tape 28 can act as conductor 50 and the resistor of FIG. 3. The electrical signal continues through conductor 54 to the lighting device 34. The electrical signal then returns to the battery device 26 through conductor 58, a resistor and another conductor 60. As shown in FIG. 2, the copper foil tape 46 can act as the conductor 60 and the resistor. The battery can selectively complete the electrical circuit 24 by an operator rotating one portion of the button cell to connect the electrical circuit 24, thus providing power to light the LED and selectively activating the LED. When the LED is activated, it illuminates the rear side 20 of the light transmissive pane (e.g. a photographic slide) (best seen in FIG. 2). It is to be appreciated that the described circuitry is but one example and is not meant to be limiting to the present disclosure. For example, the circuitry can be built or incorporated on a printed circuit board (PCB) or a "Flexible PCB" in addition to or in place of the described electrical circuit 24 mounted to the light transmissive pane 14. As shown in FIG. 4, the lighting device 34 can pass light through the light transmissive pane 14 as represented by arrow 56, thus illuminating the light transmissive pane 14.

Figure 5:
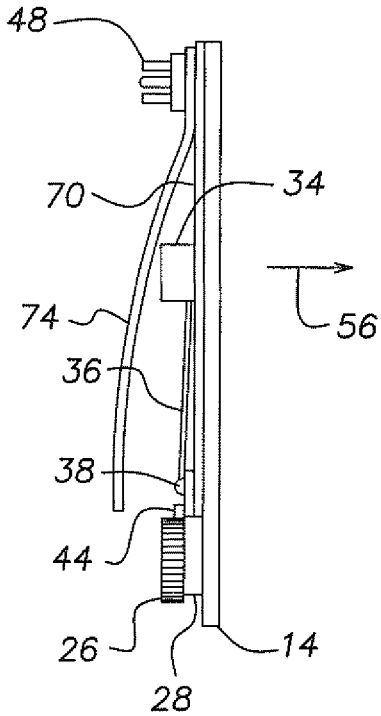
FIG. 5 is similar to FIG. 4, showing the arrangement of a diffusion panel and a backing.

Turning to FIG. 5, the wearable piece of jewelry 10 can include additional features. For example, the wearable piece of jewelry 10, a diffusion panel 70 is located between the light transmissive pane 14 (e.g. a photographic slide) and lighting device 34 (e.g. an LED). The diffusion panel 70 is configured to remove "hot spots" where a viewer would see obviously brighter sections of the light transmissive pane 14 correlating with the location of the lighting device 34 behind the light transmissive pane 14. The diffusion panel 70 can also diffuse light from the lighting device 34 relatively evenly over one surface of the light transmissive pane 14. In one example, the diffusion panel 70 can be attached directly to the light transmissive pane 14. The diffusion panel 70 can be constructed of various materials that have the ability to diffuse light directed at the diffusion panel 70. In one example, the diffusion panel 70 can be composed of computer monitor diffuser material taken from discarded computer monitors.

Additionally, the wearable piece of jewelry 10 can include a backing 74. The backing 74 can be constructed of any suitable material. Arrangement of the backing 74 can provide a smooth surface to the rear of the wearable piece of jewelry 10. It is to be appreciated that the dimensions of some of the components in the side views provided by FIGS. 4 and 5 are exaggerated to better show some elements. For example, insulating material 44 can be electrical tape which can have a thickness much smaller than that represented in FIGS. 4 and 5. As such, the backing 74 can be much closer to the light transmissive pane 14 and provide a more linear surface.

Furthermore, the backing 74 can be configured to "box in" the volume around the rear side 20 of the light transmissive pane 14. The surface of the backing 74 can also be a light color such as white. Both the configuration of the box around the rear side 20 and the light color of the surface can promote shifting and/or reflecting light created by the lighting device 34 to pass through the light transmissive pane 14 in the direction indicated by arrow 56. As such, the backing 74 can promote greater efficiency of the lighting device 34 by directing as much created light as possible through the light transmissive pane 14.

Figure 6:
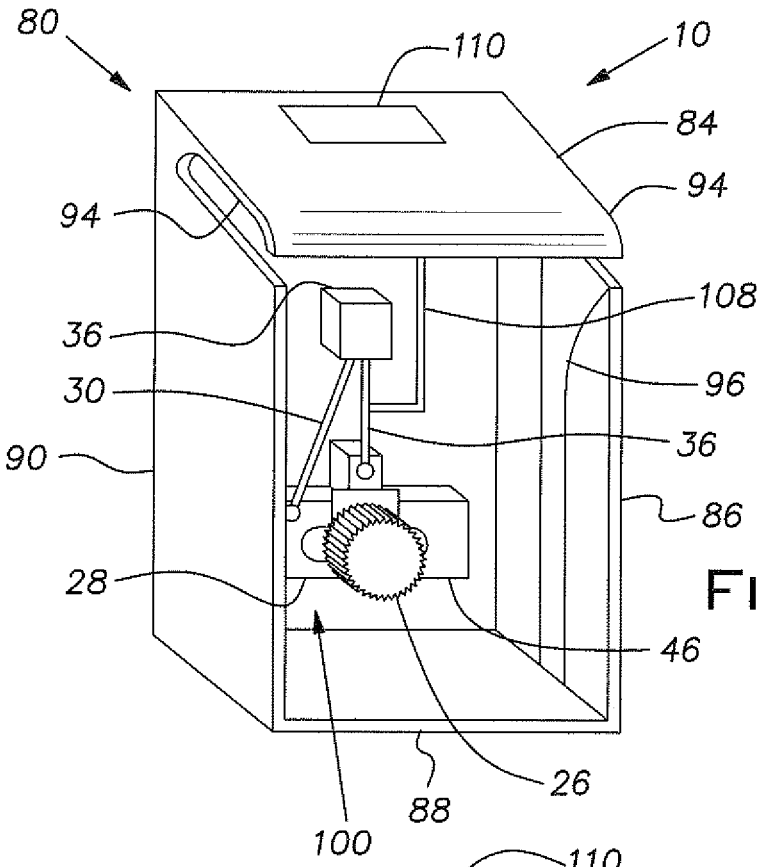
FIG. 6 is a schematic perspective view of another embodiment of a wearable piece of jewelry including a frame, a slot for a light transmissive pane and a solar cell.

Turning to FIG. 6, another embodiment of the wearable piece of jewelry 10 can include a frame 80. The frame 80 can include a top 84, sides 86, 90, a bottom 88, and a rear surface 100 which are configured to encase the electrical circuit 24, the lighting device 34, and the light transmissive pane 14 (best seen in FIG. 7). The frame 80 bounds at least one portion of the light transmissive pane 14 to hold the light transmissive pane 14 in a desired location. As described previously, the light transmissive pane 14 can be located between a viewer and the lighting device 34, held in place by the frame 80. In one particular example, the frame 80 can include structure such as a slot 96 configured to bound at least one portion of the light transmissive pane 14, thus holding the light transmissive pane 14 in a desired position. While only one slot 96 is shown, it is to be appreciated that there can be a plurality of slots 96 within the frame 80 configured to hold a photographic slide or be otherwise configured to hold any other type of light transmissive pane as described previously.

Figure 7:
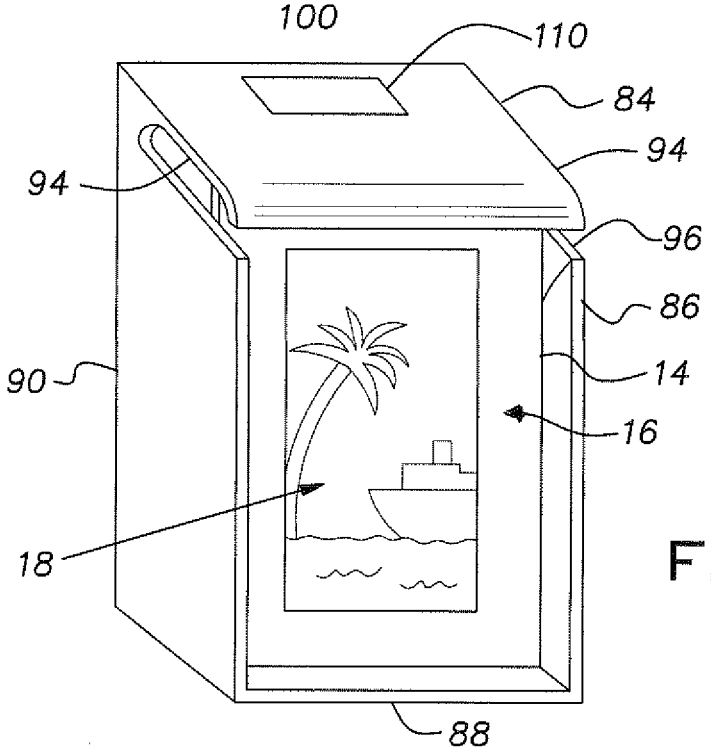
FIG. 7 is similar to FIG. 6 showing a light transmissive pane located within the slot(s) of the frame and underneath clips within the frame.

In the shown example, the frame 80 can also include flexible clips 94 at the upper end of the slot 96 in order to hold the light transmissive pane 14 in the slot 96. After the light transmissive pane 14 is inserted into the slot(s) 96, an upper edge of the light transmissive pane 14 (e.g., a photographic slide) can be urged to a position underneath the clips 94 as shown in FIG. 7. The shown example of the slots 96 is not meant to be limiting, and other structure can be used to hold the light transmissive pane 14 in a desired position such as clips, pins, springs, adhesives, screws, etc.

The described slot 96 and clip 94 arrangement for the frame 80 permit a light transmissive pane 14 that is modular or interchangeable so that a first light transmissive pane 14 can be removed from the carriage and replaced with a second light transmissive pane. In this way, the user or wearer can interchange photographic slides, or other examples of light transmissive panes in order to suit the mood or whim of the wearer. It is to be appreciated that the construction of the wearable piece of jewelry 10 can be configured to help direct a significant portion of the light output from the lighting device 34 to the rear side 20 of the light transmissive pane 14. In one example, the interior surfaces of the frame 80 can be reflective, or covered with a reflective material. In another example, the frame 80 is composed of material from a computer monitor diffuser.

In another particular example, a buckle slide can be used as the frame 80 portion of the piece of jewelry. In this manner, all of the above described components can be attached to the buckle slide. The buckle slide allows the wearable piece of jewelry 10 to be worn on a messenger bag, handbag, a hair band, a barrette, hairclip or anything it can be slid around, providing the owner with an illuminated accessory.

In one example, the electrical circuit 24 can be modified to include a solar cell 110 in electrical communication with the lighting device 34 via the electrical circuit 24. The solar cell 110 can collect energy from an external light source. One example of an external light source includes the sun. Other examples of an external light source include room lighting or any other artificial light source. The energy from the external light source can power the lighting device 34, rather than deriving power from a battery device 26. In one example, the solar cell 110 can be in direct electrical connection/communication with the lighting device 34, so that whenever the solar cell 110 is exposed to a sufficient amount of external light, the lighting device 34 is powered and emitting light at least partially toward the light transmissive pane 14. In another example, the solar cell 110 can be in electrical communication with a rechargeable battery so that solar cell exposure to an external light source is used to store energy which can be used to operate the lighting device 34 for a period of time after the solar cell 110 is removed from the external light source.

Although not shown in FIG. 6 or 7, the wearable piece of jewelry 10, can include a diffusion panel 70 located between the light transmissive pane 14 (e.g. a photographic slide) and lighting device 34 (e.g. an LED). Similar to the above described example of the light transmissive pane 14 without the frame 80, the diffusion panel is configured to remove "hot spots" where a viewer would see obviously brighter sections of the light transmissive pane 14 correlating with the location of the lighting device 34 behind the light transmissive pane 14. The diffusion panel 70 can also diffuse light from the lighting device 34 relatively evenly over one surface of the light transmissive pane 14. In one example, the diffusion panel 70 can be attached directly to the light transmissive pane 14. In another example, the diffusion panel 70 can be attached to the frame 80, so that a single diffusion panel 70 can be used for multiple light transmissive panes 14 as they are interchanged to and from the frame 80. In another example, the diffusion panel 70 can be selectively removable from the frame 80 so that the wearer of the wearable piece of jewelry 10 can create a particular effect on the light transmissive pane 14 as desired. The diffusion panel 70 can be constructed of various materials that have the ability to diffuse light directed at the diffusion panel 70. In one example, the diffusion panel 70 can be composed of computer monitor diffuser material taken from discarded computer monitors.

Figure 8:
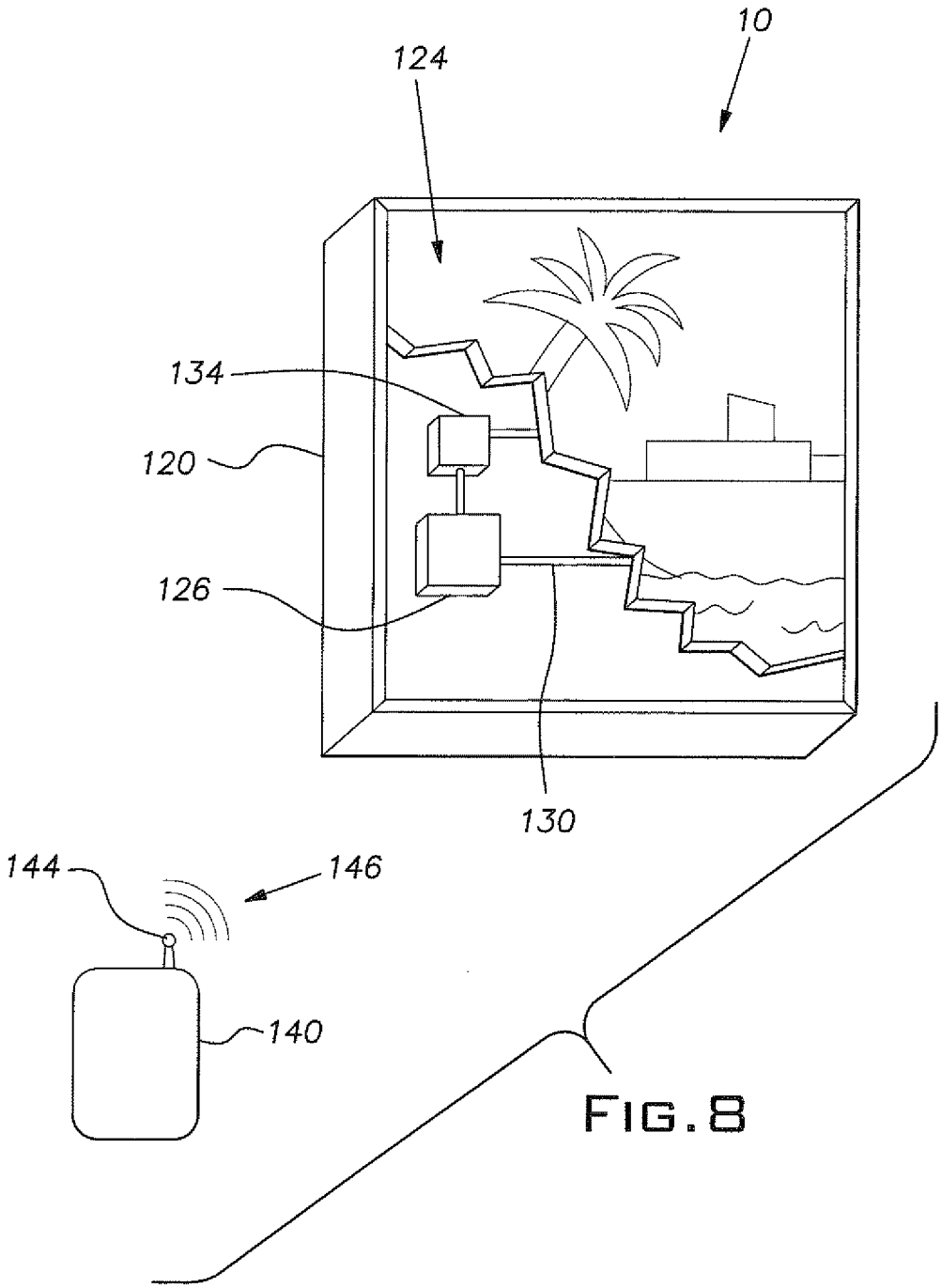
FIG. 8 is a schematic perspective view of another embodiment of a wearable piece of jewelry including a backlit screen, a controller, and a communication device.

Turning to FIG. 8, in another embodiment, the wearable piece of jewelry 10 can include a framework 120 and a lighting device that is a backlit screen 124 such as an LED or LCD viewing screen. The wearable piece of jewelry 10 also includes an electrical circuit 130 including a programmable controller 126 in electrical communication with the backlit screen 124 in order to modify the images displayed on the backlit screen 124. The electrical circuit 130 can also include a communication device 134 in electrical communication with the controller 126. The communication device 134 can be any number of communication devices including, but not limited to, a Bluetooth device, a radio frequency (RF) communication device, etc. Any of these communication devices can be in communication with a separate electronic device 140. In one example, the separate electronic device 140 can include structure such as an antenna 144 to communicate wirelessly as represented by the concentric lines 146. This wireless communication 146 can be by any suitable form such as a wireless network (wi-fi), Bluetooth, radio frequency, etc. The communication device 134 can receive information from the electronic device 140, for example, a single image or a series of images. Thus, the wearer of the wearable piece of jewelry 10 can have an electronic device 140 on his or her person to communicate an image or a series of images (e.g., a slideshow) from the separate electronic device 140 such as an iPhone or an android phone to the wearable piece of jewelry 10 where it can be passed from the electrical circuit 130 to the backlit screen 124 to be seen by viewers. The selected images, whether single or slideshow, can be tailored by the wearer to suit mood, particular themes, holidays, events, etc.

It is to be appreciated that any number of jewelry styles or designs can be used with the present disclosure. Such designs include, but are not limited to pins, brooches, rings, hair clips, barrettes, bracelets, necklaces, earrings, anklets (i.e., ankle bracelet), etc.

It is to be appreciated that the present disclosure provides a relatively inexpensive lighted piece of jewelry that is also interchangeable with the mood or desire of the wearer. Additionally, the described aspects of the piece of jewelry can be environmentally conscious. Materials such as the LEDs, computer monitor diffuser, and 35 mm photographic slides can all be repurposed from discarded materials. It is also to be appreciated that the battery as described above can be replaced by a solar cell which can be repurposed from discarded solar calculators and other such solar operated devices.

The present disclosure has been described with reference to the example embodiments described above. Modifications and alterations will occur to others upon a reading and understanding of this specification. Example embodiments incorporating one or more aspects of the present disclosure are intended to include all such modifications and alterations insofar as they come within the scope of the appended claims.

What is claimed is:

1. A wearable piece of jewelry comprising:

a light transmissive pane; and a lighting device, wherein said lighting device is configured to be selectively activated to pass light through said light transmissive pane, wherein said light transmissive pane is located between a viewer and said lighting device, wherein said light transmissive pane is a photographic slide.

2. The piece of jewelry according to claim 1, wherein said lighting device is attached directly to said light transmissive pane.

3. The piece of jewelry according to claim 1, wherein said lighting device is attached to an opaque frame of said photographic slide.

4. The piece of jewelry according to claim 1, wherein said lighting device is an LED.

5. The piece of jewelry according to claim 1, further including at least one electronic circuit.

6. The piece of jewelry according to claim 5, wherein said electronic circuit is attached directly to said light transmissive pane.

7. The piece of jewelry according to claim 1, further including a frame bounding at least one portion of said light transmissive pane to hold said light transmissive pane in a desired location, wherein said frame locates said light transmissive pane between a viewer and said lighting device.

8. The piece of jewelry according to claim 7, wherein said lighting device is attached directly to said frame.

9. The piece of jewelry according to claim 7, wherein said lighting device is configured to emit electromagnetic radiation at about the near-infrared wavelength to present different images to the human view as opposed to a sensor view.

10. The piece of jewelry according to claim 7, further including at least one electronic circuit.

11. The piece of jewelry according to claim 7, wherein said electronic circuit is attached directly to said frame.

12. The piece of jewelry according to claim 7, wherein said light transmissive pane is configured to be modular or interchangeable so that one first light transmissive pane can be removed from said frame and replaced with another light transmissive pane.

13. The piece of jewelry according to claim 1, further including a solar cell in electrical connection/communication with said lighting device, said solar cell to collect energy from an external light source to power said lighting device.

14. A wearable piece of jewelry comprising:

a light transmissive pane;

a lighting device, wherein said lighting device is configured to be selectively activated to pass light through said light transmissive pane;

a diffusion panel located between said light transmissive pane and said lighting device, said diffusion panel to remove hot spots and diffuse light from said lighting device relatively evenly over one surface of said light transmissive pane; and a frame bounding at least one portion of said light transmissive pane to hold said light transmissive pane in a desired location, wherein said frame locates said light transmissive pane between a viewer and said lighting device.

15. The piece of jewelry according to claim 14, wherein said lighting device is attached directly to said frame.

16. The piece of jewelry according to claim 14, wherein said lighting device is configured to be selectively activated to shine light through said light transmissive pane, wherein said light transmissive pane is located in a position between an eye of a viewer and said lighting device.

17. A wearable piece of jewelry comprising:

a light transmissive pane;

a lighting device, wherein said lighting device is configured to be selectively activated to pass light through said light transmissive pane, wherein said light transmissive pane is located between a viewer and said lighting device; and a diffusion panel located between said light transmissive pane and said lighting device, said diffusion panel to remove hot spots and diffuse light from said lighting device relatively evenly over one surface of said light transmissive pane, wherein said light transmissive pane is selected from the group consisting of sea glass, stained glass, etched glass, shell, bone, rock, minerals, portions of glass such as bottles, film negatives, processed film, thin paper, animation cels, plastic, etched plastic, encased liquids, encased combinations of liquids and solids, and mounted scientific slides.

18. The piece of jewelry according to claim 17, wherein said lighting device is attached directly to said light transmissive pane.

19. The piece of jewelry according to claim 17, wherein said lighting device is attached to an opaque frame about said light transmissive pane.

* * * * *